US006451521B1

(12) United States Patent
Berthaller et al.

(10) Patent No.: US 6,451,521 B1
(45) Date of Patent: Sep. 17, 2002

(54) COLOR-PHOTOGRAPHY SILVER HALIDE MATERIAL

(75) Inventors: Peter Berthaller, Bergisch-Gladbach; Matthias Feigl, Leverkusen; Hans-Ulrich Borst, Elsdorf, all of (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/671,491

(22) Filed: Sep. 27, 2000

(30) Foreign Application Priority Data

Sep. 29, 1999 (DE) ..... 199 46 624

(51) Int. Cl.[7] ..... G03C 1/06; G03C 7/36

(52) U.S. Cl. ..... 430/604; 430/556; 430/567; 430/583

(58) Field of Search ..... 430/604, 583, 430/567, 613, 611, 556

(56) References Cited

U.S. PATENT DOCUMENTS

| | | | | | |
|---|---|---|---|---|---|
| 3,178,289 | A | * | 4/1965 | Sottysiak | |
| 4,806,462 | A | * | 2/1989 | Yamashita et al. | 430/604 |
| 5,348,848 | A | * | 9/1994 | Murakami et al. | 430/569 |
| 5,919,612 | A | * | 7/1999 | Ly et al. | 430/583 |
| 6,010,838 | A | * | 1/2000 | Weimann et al. | 430/557 |
| 6,066,443 | A | * | 5/2000 | Dobles et al. | 430/583 |

FOREIGN PATENT DOCUMENTS

| | | |
|---|---|---|
| DE | 19617767 | 9/1997 |
| EP | 563946 | 6/1993 |
| JP | 4125629 | 4/1992 |
| JP | 8286296 | 1/1996 |

* cited by examiner

*Primary Examiner*—Thorl Chea
(74) *Attorney, Agent, or Firm*—Connolly Bove Lodge & Hutz LLP

(57) ABSTRACT

A color-photography silver halide material having a base and at least one photosensitive silver halide emulsion layer which is applied thereto and whose silver halide comprises at least 95 mol-%, preferably of 98.5%, of AgCl and contains $10^{-7}$ to $10^{-3}$ mol of at least one metal selected from indium, yttrium, lanthanum and the lanthanides per mol of silver halide is remarkable for improved low-density stability in the unexposed state.

15 Claims, No Drawings

COLOR-PHOTOGRAPHY SILVER HALIDE MATERIAL

The invention relates to a photosensitive color photographic silver halide material which contains, in at least one layer, at least one spectrally sensitized silver halide emulsion containing at least 95 mol-% AgCl, preferably at least 98.5 mol-% AgCl, and has improved low-density stability in the unexposed state (lower storage fog).

It is known that AgCl emulsions frequently have a high fog which is produced by reduction of silver ions to metallic silver during the precipitation. To avoid this, oxidizing agents such as Hg salts, permanganates, peroxides and persulfates are added. Said oxidizing agents frequently have a negative effect on the photographic properties, particularly on the sensitivity.

It is furthermore known that silver halide emulsions having a high chloride content exhibit a density increase in the region of the threshold gradation during storage, regardless of the spectral sensitivity. The heat stability of spectrally sensitized, in particular blue-sensitized, silver chloride emulsions is also unsatisfactory in the region of low densities.

The object of the invention was to avoid these disadvantageous effects.

It was found that the addition of salts of indium, of yttrium, of lanthanum and of the rare earths cerium, praseodymium, neodymium, promethium, samarium, europium, gadolinium, terbium, dysprosium, holmium, erbium, thulium, ytterbium and lutetium, referred to below as earth-metal salts, to one of the solutions of the emulsion mixture for producing a photosensitive silver halide emulsion having a high chloride content results in an unexpected improvement in the fog in the fresh state and in the stability of the photographic properties during storage in the unexposed state, whereas the low densities (emulsion fog and threshold gradation) are essentially kept stable at elevated temperature.

Disadvantageous alterations in the photographic properties of the emulsions are not associated with the addition, according to the invention, of the earth-metal salts.

The addition of rare-earth-metal salts to silver halide emulsions has hitherto been disclosed (U.S. Pat. No. 3,178,289) only in connection with the improvement of the point quality in photographic emulsions containing at least 7.5 mol-% AgBr which are subjected to a lith development.

The doping of a silver halide emulsion whose grains have at least 4 shells, of which at least one shell, but not all the shells, are doped with indium or lanthanum and the like or another shell, but not all the shells are doped with iodine, results, in black/white materials, in a stabilization of the photographic properties (DE 37 23 419).

The invention consequently relates to a color photographic silver halide material having a base and at least one photosensitive silver halide emulsion layer which is applied thereto and whose silver halide comprises at least 95 mol-%, preferably at least of 98.5%, of AgCl, characterized in that the silver halide emulsion contains $10^{-7}$ to $10^{-3}$ mol of at least one metal selected from indium, yttrium, lanthanum and the lanthanides per mol of silver halide.

The silver halide crystals are preferably prismatic, cubic or tabular. They are, in particular, blue-sensitized.

The silver halide crystals according to the invention are prepared in that the silver halide precipitation is performed in the presence of soluble salts of metals of the lanthanide group, of indium or of yttrium or are redissolved with fine-grain silver halide crystals doped with the said metals.

According to the invention, the soluble simple or complex salts, including the halides, sulfates and nitrates of the bivalent, trivalent or tetravalent metals, in particular, are used as soluble earth metal salts.

The amount of halide of the silver halides required to make up to 100 mol-% is preferably AgBr.

The color photographic silver halide material is, in particular, a print material.

Preferably the following metal salts are used: Pr, Eu, Ce and In.

The emulsions according to the invention are ripened in the normal manner, stabilized, chemically and spectrally sensitized and mixed with the usual emulsion additives.

Suitable as ripening agents are, for example, thiosulfate, thiourea, open-chain and cyclic thioamides, thiocarbamates, xanthogenates, selenoureas, open-chain or cyclic selenoamides, heterocyclic, in particular heteroaromatic selenols, phosphane selenides, selenium sulfates, selenium phosphates, selenium phosphonates, selenium phosphoramides.

Preferred blue-sensitizers correspond to the formula (I)

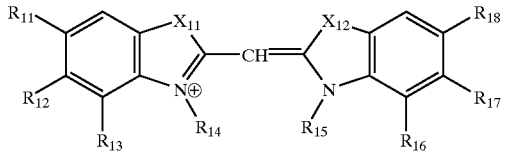

(I)

wherein $R_{11}$ to $R_{13}$ and $R_{16}$ to $R_{18}$ represent H, alkyl, alkoxy, halogen, 2-thienyl, 3-thienyl, 1-pyrrolyl, 2-pyrrolyl, phenyl, 1-indolyl, 2-furanyl, 3-furanyl or carbazolyl, $R_{14}$ and $R_{15}$ represent alkyl, sulfoalkyl, carboxyalkyl, $—(CH_2)_nSO_2N^{\theta}—COR_{19}$, $—(CH_2)_nSO_2N^{\theta}SO_2R_{19}$, $—(CH_2)_nCON^{\theta}SO_2R_{19}$ or $—(CH_2)_nCON^{\theta}COR_{19}$, $X_{11}$ and $X_{12}$ represent O, S, Se, or $NR_{20}$, M represents a counterion, n represents an integer from 2 to 4 and $R_{19}$ and $R_{20}$ represent $C_1$–$C_4$-alkyl or $R_{11}$ and $R_{12}$ or $R_{12}$ and $R_{13}$, $R_{16}$ and $R_{17}$ or $R_{17}$ and $R_{18}$ represent the remaining members of a fused benzene or naphthalene ring.

Particularly preferred blue-sensitizers correspond to the formula (II)

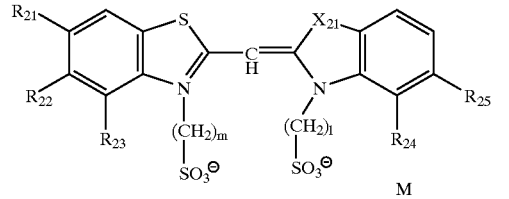

(II)

wherein $R_{21}$ and $R_{23}$ represent hydrogen $R_{22}$ represents halogen, in particular chlorine or fluorine, 2-thienyl, 3-thienyl, 1-pyrrolyl, 2-furanyl, 1-indolyl or phenyl or $R_{21}$ and $R_{22}$ taken together or $R_{22}$ and $R_{23}$ taken together represent the remaining members of a fused benzene or naphthalene ring, $R_{24}$ represents hydrogen, $R_{25}$ represents halogen, in particular chlorine or fluorine, phenyl, 2-thienyl, 3-thienyl, 1-pyrrolyl, 2-furanyl, 1-indolyl or $R_{24}$ and $R_{25}$ taken together represent the remaining members of a fused benzene or naphthalene ring, $X_{21}$ represents S or O, M represents a counterion, in particular triethylamrnonium, and l and m represent an integer from 2 to 4.

The blue-sensitized silver halide emulsion contains, in particular, a stabilizer selected from the 1-phenyl-5-mercaptotetrazoles.

The blue-sensitized silver halide emulsion layer normally contains at least one yellow-coupler, preferably a biequivalent yellow-coupler.

Preferred as two-equivalent yellow-couplers are acetanilides, in particular pivaloyl-acetanilides and malonanilides whose labile groups are linked via O or N with the coupler molecule and which are substituted in the ortho-position of the anilide part by chlorine, alkoxy or aryloxy.

Particularly preferred two-equivalent yellow couplers correspond to the formula (III):

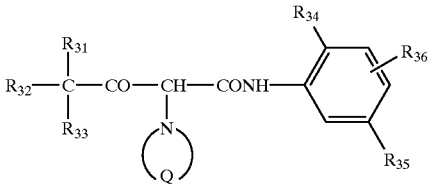

wherein $R_{31}$ represents alkyl, preferably containing 1 to 4 C atoms, in particular methyl, $R_{32}$ represents alkyl, preferably containing 1 to 4 C atoms, in particular methyl, $R_{33}$ represents a hydrogen atom or alkyl, preferably containing 1 to 4 C atoms, in particular methyl, or $R_{32}$ and $R_{33}$ taken together represent the remaining members of a cyclopropyl radical, $R_{34}$ represents chlorine or alkoxy, $R_{35}$ represents —NHCO—$R_{37}$, —$SO_2$NH—$R_{37}$, —NH$SO_2$—$R_{37}$, —COO$R_{37}$, Cl, Br or alkoxy, $R_{36}$ represents a hydrogen or chlorine atom, $R_{37}$ represents a substituent, in particular a ballast group and Q represents the remaining members of a substituted imidazole, imidazolidinedione, oxazolidinedione or triazolidinedione ring, wherein the alkyl groups may be further substituted.

Suitable yellow couplers are (III-1)

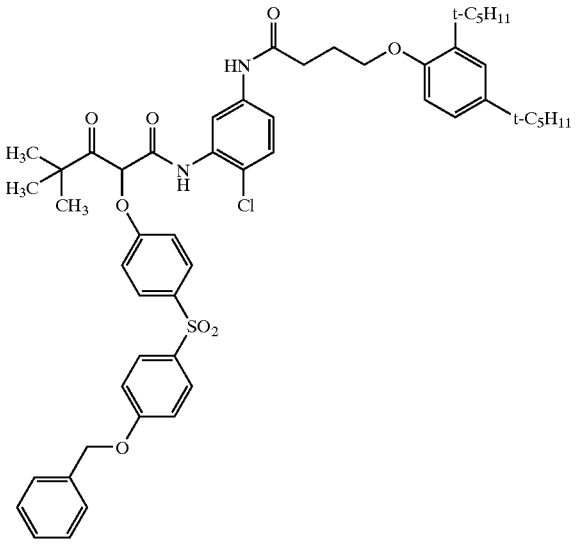

(III-2)

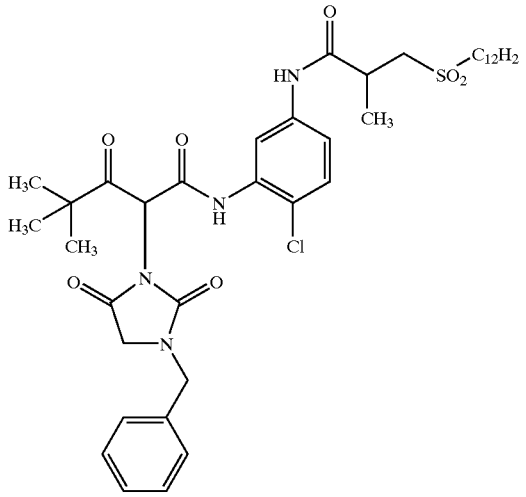

(III-3)

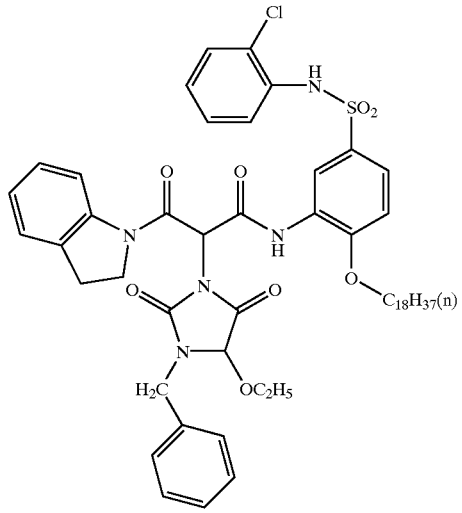

-continued
(III-4)
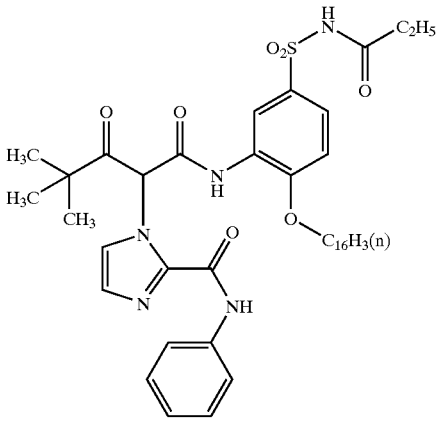
(III-5)
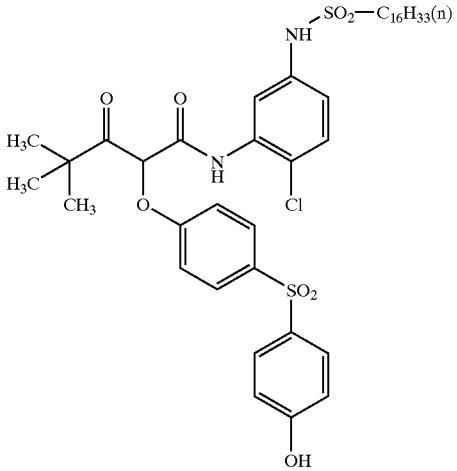
(III-6)
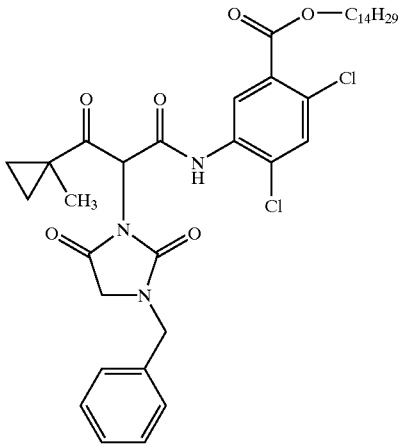
-continued
(III-7)
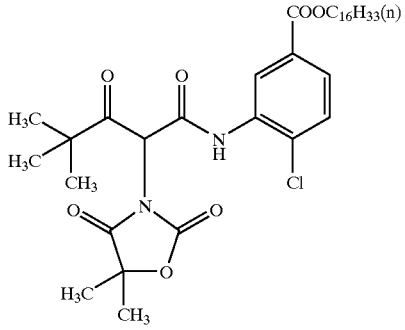
(III-8)
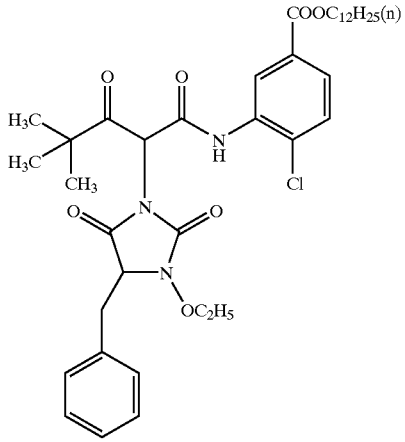
(III-9)
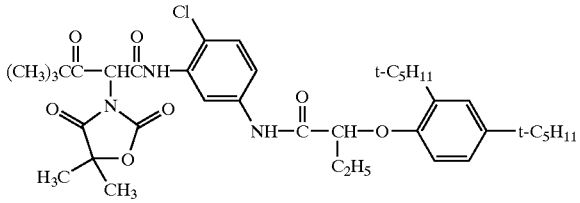
(III-10)
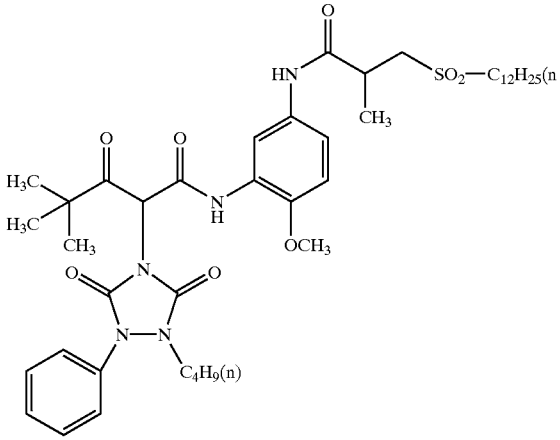
Suitable compounds of the formula (II) are the following, in which 1 and m=3 and triethylammonium is counterion:

| | $X_3$ | $R_{21}$ | $R_{22}$ | $R_{23}$ | $R_{24}$ | $R_{25}$ |
|---|---|---|---|---|---|---|
| II-1 | S | H | 2-thienyl | H | H | Cl |
| II-2 | S | H | 3-thienyl | H | H | Cl |
| II-3 | S | H | 1-pyrrolyl | H | H | Cl |
| II-4 | S | H | 2-furyl | H | H | F |
| II-5 | S | H | 1-indolyl | H | H | Cl |
| II-6 | S | H | benzo | | H | Cl |
| II-7 | S | H | Cl | H | H | Cl |
| II-8 | S | H | 1,2-naphtho | | H | Cl |
| II-9 | O | H | 2,3-naphtho | | H | Cl |
| II-10 | O | 1,2-naphtho | | H | benzo | |
| II-11 | S | H | Cl | H | H | phenyl |
| II-12 | S | H | benzo | | benzo | |
| II-13 | O | H | benzo | | 1,2-naphtho | |
| II-14 | S | H | 2-thienyl | H | H | 2-thienyl |
| II-15 | S | H | 3-thienyl | H | H | 3-thienyl |
| II-16 | S | H | 1-pyrrolyl | H | H | 1-pyrrolyl |
| II-17 | S | H | 1-indolyl | H | H | 1-indolyl |
| II-18 | S | H | Cl | H | benzo | |

Examples of color photographic silver halide materials are color photographic paper, color-reversal photographic paper and semi-transparent display material. An overview is to be found in Research Disclosure 37038 (1995), Research Disclosure 38957 (1996) and Research Disclosure 40145 (1997).

The color photographic silver halide materials comprise a base to which at least one photosensitive silver halide emulsion layer is applied. Suitable bases are, in particular, thin films and sheets. An overview of base materials and auxiliary layers applied to their front and back sides is presented in Research Disclosure 37254, Part 1 (1995), page 285 and in Research Disclosure 38957, Part XV (1996), page 627.

The color photographic silver halide materials normally contain at least one red-sensitive, green-sensitive and blue-sensitive silver halide emulsion layer, respectively, and also, optionally, interlayers and protective layers.

Depending on the nature of the photographic silver halide materials, said layers may. be arranged differently. This may be explained for the most important products:

Color photograph paper and color photographic display material normally have on the base in the sequence specified below a blue-sensitive, yellow-coupling silver halide emulsion layer, a green-sensitive, magenta-coupling silver halide emulsion layer and a red-sensitive, cyan-coupling silver halide emulsion layer, respectively; a yellow filter layer is unnecessary.

Modifications may be made to the number and arrangement of the photosensitive layers to achieve certain results. For example, colour papers may also contain otherwise sensitized interlayers by means of which the gradation may be influenced.

Essential constituents of the photographic emulsion layers are binders, silver halide grains and colour couplers.

Details on suitable binders are to be found in Research Disclosure 37254, Part 2 (1995), page 286 and in Research Disclosure 38957, Part II.A (1996), page 598.

Details on suitable silver halide emulsions, their preparation, ripening, stabilization and spectral sensitization, including suitable spectral sensitizers, are to be found in Research Disclosure 37254, Part 3 (1995), page 286, in Research Disclosure 37038, Part XV (1995), page 89 and in Research Disclosure 38957, Part V.A (1996), page 603.

The spectral sensitizers can be added in dissolved form or as dispersed substances to the photographic emulsion. Both solution and dispersed substance may contain additives, such as wetting agents or buffers.

The spectral sensitizer or a combination of spectral sensitizers can be added before, during or after the preparation of the emulsion.

Details on colour couplers are to be found in Research Disclosure 37254, Part 4 (1995), page 288, in Research Disclosure 37038, Part II (1995), page 80 and in Research Disclosure 38957, Part X.B (1996), page 616. The maximum absorption of the dyestuffs formed from the couplers and the colour developer oxidation product is, for copying materials, preferably in the following ranges: yellow coupler 440 to 450 nm, magenta coupler 540 to 560 nm, cyan coupler 640 to 670 nm.

The usual magenta couplers in copier materials are almost exclusively those selected from the anilinopyrazolones, the pyrazolo[5.1-c](1,2,4)triazoles or the pyrazolo[1.5-b](1,2,4) triazoles.

The non-photosensitive interlayers disposed as a rule between layers of different spectral sensitivity may contain agents which prevent an undesirable diffusion of developer oxidation products out of one photosensitive layer into another photosensitive layer having different spectral sensitization.

Suitable compounds (white coupler, scavengers or EOP traps) are to be found in Research Disclosure 37254, Part 7 (1995), page 292, in Research Disclosure 37038, Part III (1995), page 84 and in Research Disclosure 38957, Part X.D (1996), page 621 ff.

The color photographic material may furthermore contain UV-absorbing compounds, white toners, spacers, filter dyes, formalin traps, light protection agents, antioxidants, $D_{min}$ dyes, plasticizers (latices), biocides and additives for improving the coupler and dye stability, for reducing the colour fog and for reducing the yellowing, etc. Suitable compounds are to be found in Research Disclosure 37254, Part 8 (1995), page 292, in Research Disclosure 37038, Parts IV, V, VI, VII, X, XI and XIII (1995), page 84 ff and in Research Disclosure 38957, Parts VI, VIII, IX and X (1996), page 607 and 610 ff.

The layers of color photographic materials are normally cured, i.e. the binder used, preferably gelatin, is crosslinked by suitable chemical methods.

Suitable curing substances are to be found in Research Disclosure 37254, Part 9 (1995), page 294, in Research Disclosure 37038, Part XII (1995), page 86 and in Research Disclosure 38957, Part II.B (1996), page 599.

After imagewise exposure, color photographic materials are processed by various methods in accordance with their nature. Details on the procedures and the chemicals needed therefor are published in Research Disclosure 37254, Part 10 (1995), page 94, in Research Disclosure 37038, Parts XVI to XXIII (1995), page 95 ff and in Research Disclosure 38957, Parts XVIII, XIX and XX (1996), page 630 ff together with exemplary materials.

EXAMPLES

Example 1

Emulsion A (Comparison)

The following solutions are prepared using demineralized water:

| | |
|---|---|
| Solution 1: | 7000 ml of water<br>540 g of gelatin |

-continued

| | |
|---|---|
| Solution 2: | 7000 ml of water |
| | 1300 g of NaCl |
| | 1.2 g of compound X-1 |
| Solution 3: | 7000 ml of water |
| | 3000 g of Ag $NO_3$ |

Emulsion A:

Solutions 2 and 3 are added simultaneously to solution 1 while stirring vigorously at 60° C. in the course of 120 minutes at a pAg of 7.7. A silver chloride emulsion having a mean particle diameter of 0.8 μm is obtained. The ratio of gelatin to silver is 0.18. The emulsion is flocculated in a known manner, washed and re-dispersed with enough gelatin for the gelatin/Ag ratio by weight to be 0.56. The emulsion contains 1 mol of silver chloride per kg. Optimum ripening is then carried out at 60° C. at a pH of 4.5 using 3.5 μmol/$KAuCl_4$/mol Ag and 1.5 μmol $Na_2S_2O_3$/mol Ag. After chemical ripening, the emulsion is spectrally sensitized with II-18 and stabilized with 350 μmol of 1-(3-acetamidophenyl)-5-mercaptotetrazole.

Emulsion B: (Invention/doping with indium(III) bromide according to the invention)

The emulsion is prepared in the same way as emulsion A, but with the difference that the halide Solution 2 contained 6 μmol of indium tribromide per mol of $AgNO_3$.

Emulsion C: (Invention/doping with cerium(III) chloride according to the invention)

The emulsion is prepared in the same way as emulsion A, but with the difference that the halide solution 2 contained 6 μmol of cerium trichloride per mol of $AgNO_3$.

Emulsion D: (Invention/doping with praseodymium(III) chloride according to the invention)

The emulsion is prepared in the same way as emulsion A, but with the difference that the halide solution 2 contained 6 μmol of praseodymium trichloride per mol of $AgNO_3$.

Emulsion E: (Invention/doping with europium(III) chloride according to the invention)

The emulsion is prepared in the same way as emulsion A, but with the difference that the halide solution 2 contained 6 μmol of europium trichloride per mol of $AgNO_3$.

Emulsion F: (Invention/doping with samarium(III) chloride according to the invention)

The emulsion is prepared in the same way as emulsion A, but with the difference that the halide solution 2 contained 6 μmol of samarium trichloride per mol of $AgNO_3$.

The emulsions A–F are each mixed with yellow coupler III-8 emulsified in tricresyl phosphate and applied to a film base comprising paper coated on both sides with polyethylene.

The poured individual layers contain per $m^2$:

0.63 g of $AgNO_3$ 1.38 g of gelatin 0.95 g of yellow coupler III-8

0.29 g of tricresyl phosphate

The materials are cured by applying a protective layer composed of 0.2 g of gelatin and 0.3 g of instant hardener SHM-1 per $m^2$. Samples thereof are exposed imagewise behind a gradation wedge and processed by the Ektacolor RA-4 process (Samples 1–6).

A further sample of each individual material is subjected in each case to storage for 28 days at 37° C. in the unexposed state, then exposed imagewise between a gradation Wedge and processed in the same way by the Ektacolor RA-4 process (Samples 7–12).

The sensitometric results are shown in Table 1:, in particular,

TABLE 1

| Emulsion/Sample | $D_{min}$ | Threshold gradation | Comp./Inv. |
|---|---|---|---|
| A Sample 1 | 0.132 | 1.40 | Comp. |
| A Sample 7 | 0.195 | 1.13 | Comp. |
| B Sample 2 | 0.099 | 1.48 | Inv. |
| B Sample 8 | 0.108 | 1.46 | Inv. |
| C Sample 3 | 0.107 | 1.47 | Inv. |
| C Sample 9 | 0.116 | 1.46 | Inv. |
| D Sample 4 | 0.106 | 1.51 | Inv. |
| D Sample 10 | 0.113 | 1.50 | Inv. |
| E Sample 5 | 0.103 | 1.50 | Inv. |
| E Sample 11 | 0.100 | 1.48 | Inv. |
| F Sample 6 | 0.100 | 1.47 | Inv. |
| E Sample 12 | 0.119 | 1.44 | Inv. |

It emerges from the result that the desired properties, namely high resistance to heat with low fog, are achieved only with the lanthanide doping measure during precipitation according to the invention.

SHM-1 has the formula:

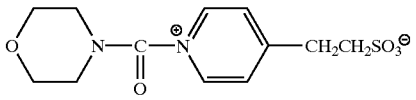

Compound X-1 has the formula: $C_2H_5SCH_2CH_2SCH_2CH_2NHCONH_2$

Example 2

A color photographic recording material suitable for fast processing was prepared by applying the following films in the specified sequence to a film base comprising paper coated on both sides with polyethylene. The quantitative data relate in each case to 1 $m^2$. The appropriate amounts of $AgNO_3$ are given for the silver halide application.

| Layer structure 201 | |
|---|---|
| Layer 1: | (substrate layer) |
| | 0.10 g of gelatin |
| Layer 2: | (blue-sensitive layer) |
| | blue-sensitive silver halide emulsion according to Table 2 |
| | 1.25 g of gelatin |
| | 0.50 g of yellow coupler GB-1 |
| | 0.30 g of tricresyl phosphate (TCP) |
| | 0.10 g of stabilizer ST-1 |
| Layer 3: | (interlayer) |
| | 0.10 g of gelatin |
| | 0.06 g of EOP trap SC-1 |
| | 0.06 g of EPO trap SC-2 |
| | 0.12 g of TCP |
| Layer 4: | (green-sensitive layer) |
| | green-sensitive silver halide emulsion containing (99.5 mol-% chloride, 0.5 mol-% bromide, mean grain diameter 0.45 μm) composed of 0.2 g of $AgNO_3$, spectrally sensitized with |
| | 0.12 mg of the compound GS-1 |
| | 1.10 g of gelatin |
| | 0.10 g of magenta coupler PP-1 |
| | 0.10 g of magenta coupler PP-2 |
| | 0.15 g of stabilizer ST-2 |
| | 0.20 g of stabilizer ST-3 |
| | 0.20 g of TCP |
| | 0.02 g of isotetradecanol |
| Layer 5: | (UV protective layer) |
| | 1.05 g of gelatin |
| | 0.20 g of UV absorber UV-1 |

-continued

| Layer structure 201 | |
|---|---|
| | 0.05 g of UV absorber UV-2 |
| | 0.22 g of UV absorber UV-3 |
| | 0.06 g of EOP trap SC-1 |
| | 0.06 g of EOP trap SC-2 |
| | 0.25 g of TCP |
| Layer 6: | (red-sensitive layer) |
| | red-sensitive silver halide emulsion (99.5 mol-% chloride, 0.5 mol-% bromide, mean grain diameter 0.48 $\mu$m) composed of 0.28 g of $AgNO_3$ spectrally sensitized with 0.04 mg of the compound V-1 and stabilized with 0.56 mg of stabilizer ST-4. |
| | 1.00 g of gelatin |
| | 0.40 g of cyan coupler BG-1 |
| | 0.40 g of TCP |
| Layer 7: | (UV protective layer) |
| | 1.05 g of gelatin |
| | 0.20 g of UV absorber UV-1 |
| | 0.05 g of UV absorber UV-2 |

-continued

| Layer structure 201 | |
|---|---|
| | 0.22 g of UV absorber UV-3 |
| | 0.15 g of TCP |
| Layer 8: | (protective layer) |
| | 0.90 g of gelatin |
| | 0.05 g of white toner W-1 |
| | 0.07 g of polyvinylpyrrolidone |
| | 1.20 mg of silicone oil |
| | 2.50 mg of a spacer composed of poly(methyl methyacrylate), mean particle size 0.8 $\mu$m |
| | 0.30 g of instant hardener SHM-1 (see Example 1) |

In Example 2, the following compounds are used:

GB-1

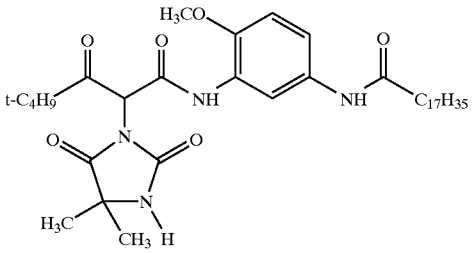

PP-1

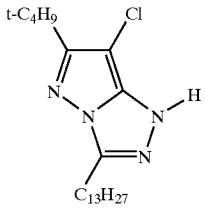

PP-2

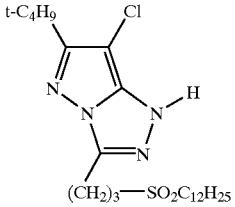

PP-3

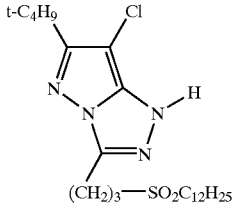

BG-1

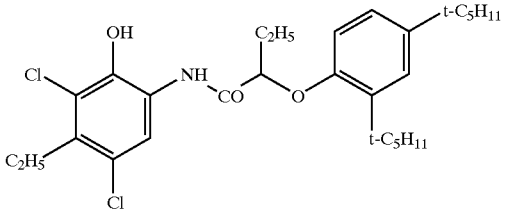

SC-1

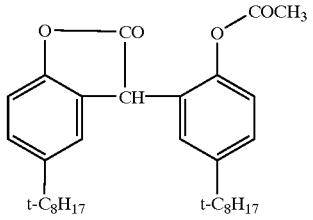

SC-2

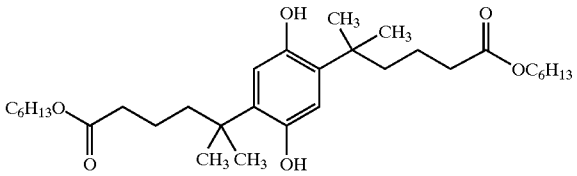

UV-1

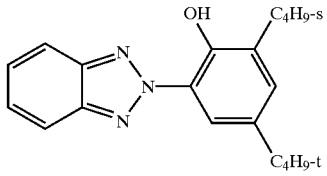

-continued

UV-2

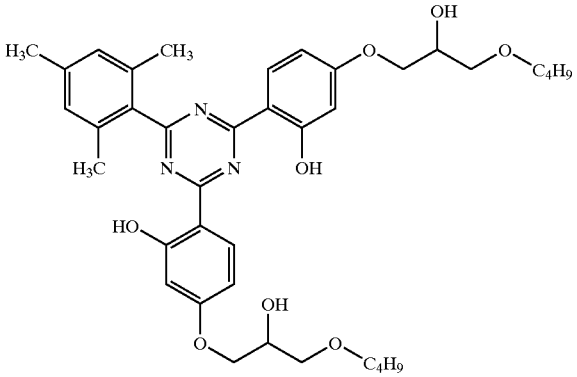

UV-3

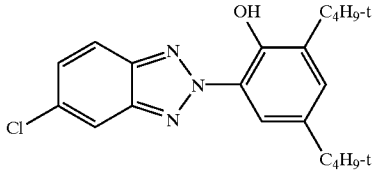

ST-1

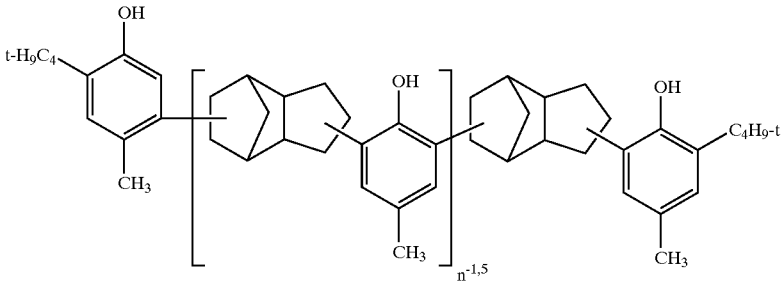

ST-2

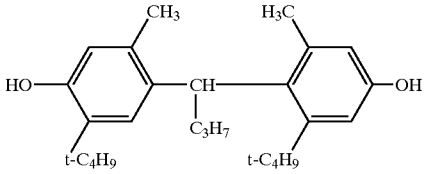

ST-3

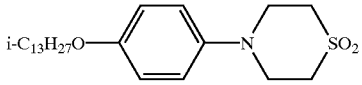

ST-4

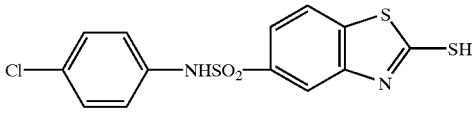

GS-1

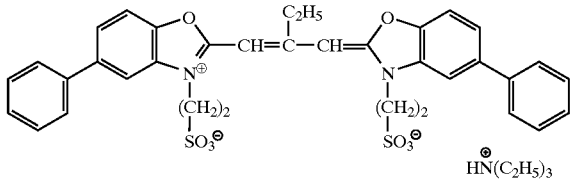

W-1

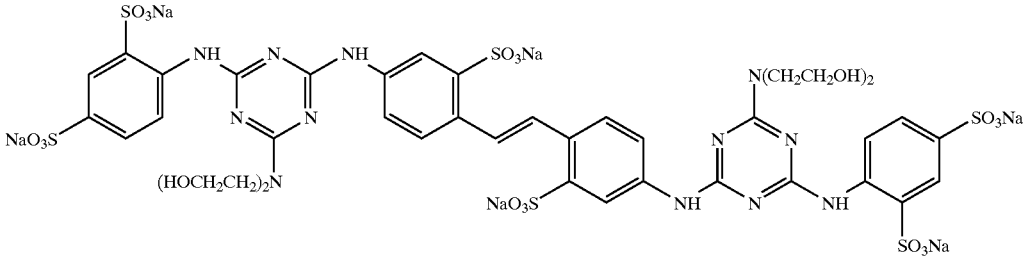

Processing

A sample of each material was exposed behind a gradation wedge, developed in the process below and gradation and fog were investigated (Samples 1 and 2). The results are recorded in Table 2. Another sample was stored for 4 weeks at 37° C. and then exposed and processed in the same way (Samples 3 and 4).

a) Colour developer - 45 s - 35° C.

| | |
|---|---|
| Triethanolamine | 9.0 g |
| N,N-diethylhydroxylamine | 2.0 g |
| Bis(2-sulfoethyl)-hydroxylamine, disodium salt | 2.0 g |

-continued

| | |
|---|---|
| Diethylene glycol | 0.05 g |
| 3 methyl-4-amino-N-ethyl-N-methane sulfonamidoethylaniline sulfate | 5.0 g |
| Potassium sulfite | 0.2 g |
| Triethylene glycol | 0.05 g |
| Potassium carbonate | 22 g |
| Potassium hydroxide | 0.4 g |
| Ethylenediaminetetraacetic acid, disodium salt | 2.2 g |
| Potassium chloride | 2.5 g |
| 1,2-dihydroxybenzene-3,4,6-trisulfonic acid, trisodium salt | 0.3 g |
| made up to 1000 ml with water; pH 10.0 | |
| b) Bleach-fixing - 45 s - 35° C. | |
| Ammonium thiosulfate | 75 g |
| Sodium hydrogensulfite | 13.5 g |
| Ammonium acetate | 2.0 g |
| Ethylenediaminetetraacetic acid (iron ammonium salt) | 57 g |
| Ammonia, 25% | 9.5 g |
| made up to 1000 ml with acetic acid; pH 5.5 | |
| c) Washing - 2 min - 33° C. | |
| d) Drying | |

TABLE 2

| Sample | Emulsion | Doping | Gradation | $D_{min}$ |
|---|---|---|---|---|
| 1 | A | — | 1.73 | 0.142 |
| 2 | D | Pr | 1.73 | 0.118 |
| 3 | A | — | 1.34 | 0.240 |
| 4 | D | Pr | 1.70 | 0.128 |

What is claimed is:

1. A color photographic silver halide material comprising a base and at least one photosensitive silver halide emulsion layer which is applied thereto and the silver halide comprises at least 95 mol-% of AgCI, and the silver halide emulsion contains $10^{-7}$ to $10^{-3}$ mol of at least one metal selected from the group consisting of rare earths cerium, praseodymium, neodymium, promethium, samarium, europium, gadolinium, terbium, dysprosium, holmium, erbium, thulium, ytterbium and lutetium per mol of silver halide.

2. The color photographic material according to claim 1, wherein the silver halide emulsion contains $10^{-7}$ to $10^{-3}$ mol of at least one metal selected from the group consisting of Pr, Eu and Ce.

3. The color photographic material according to claim 1, wherein the silver halide emulsion is blue-sensitized and contains at least one sensitizer of the formula

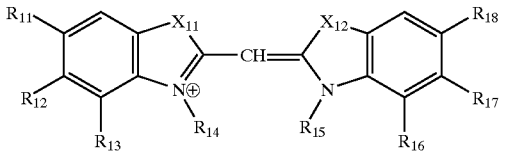

M wherein $R_{11}$, to $R_{13}$ and $R_{16}$ to $R_{18}$ independently of one another are H, alkyl, alkoxy, halogen, 2-thienyl, 3-thienyl, 1-pyrrolyl, 2-pyrrolyl, phenyl, 1-indolyl, 2-furanyl, 3-furanyl or carbazolyl, $R_{14}$ and $R_{15}$ independently of one another are alkyl, sulfoalkyl, carboxyalkyl, $—(CH_2)_nSO_2N^{\ominus}—COR_{19}$, $—(CH_2)_nSO_2N^{\ominus}SO_2R_{19}$, $—(CH_2)_nCON^{\ominus}SO_2R_{19}$ or $—(CH_2)_nCON^{63}\ COR_{19}$, $X_{11}$ and $X_{12}$ independently of one another are O, S, Se, or $NR_{20}$, M is a counterion, n is an integer from 2 to 4 and $R_{19}$ and $R_{20}$ independently of one another are $C_1$–$C_4$-alkyl or $R_{11}$ and $R_{12}$ or $R_{12}$ and $R_{13}$, $R_{16}$ and $R_{17}$ or $R_{17}$ and $R_{18}$ are the remaining members of a fused benzene or naphthalene ring and at least one stabilizer is 1-phenyl-5-mercaptotetrazole.

4. The color photographic material according to claim 3, wherein the blue-sensitizer corresponds to the formula (II)

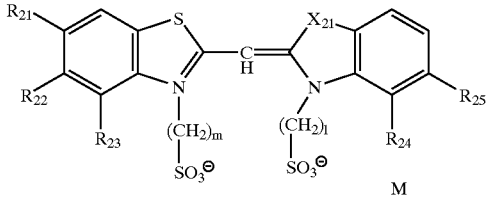

(II)

M wherein $R_{21}$ and $R_{23}$ are hydrogen, $R_{22}$ is halogen, 2-thienyl, 3-thienyl, 1-pyrrolyl, 2-furanyl, 1-indolyl or phenyl or $R_{21}$ and $R_{22}$ taken together or $R_{22}$ and $R_{23}$ taken together are the remaining members of a fused benzene or naphthalene ring, $R_{24}$ is hydrogen, $R_{25}$ is halogen, phenyl, 2-thienyl, 3-thienyl, 1-pyrrolyl, 2-furanyl, or 1-indolyl or $R_{24}$ and $R_{25}$ taken together are the remaining members of a fused benzene or naphthalene ring, $X_{21}$ is S or O, M is a counterion and l and m independently of one another represent an integer from 2 to 4.

5. The color photographic material according to claim 1, wherein the at least one silver halide emulsion layer contains a two-equivalent yellow coupler of the formula

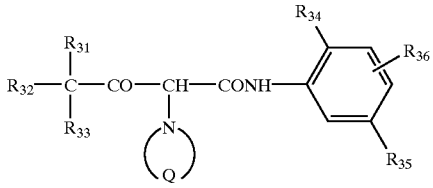

wherein, $R_{31}$ is alkyl, $R_{32}$ is alkyl, $R_{33}$ is a hydrogen atom or alkyl, or $R_{32}$ and $R_{33}$ taken together are the remaining members of a cyclopropyl radical, $R_{34}$ is chlorine or alkoxy, $R_{35}$ is $—NHCO—R_{37}$, $—SO_2NH—R_{37}$, $—NHSO_2—R_{37}$, $—COOR_{37}$, Cl, Br or alkoxy, $R_{36}$ is a hydrogen or chlorine atom, $R_{37}$ is a substituent, and Q represents the remaining members of a substituted imidazole, imidazolidinedione, oxazolidinedione or triazolidinedione ring, wherein the alkyl groups are optionally substituted.

6. The color photographic material according to claim 1, wherein the silver halide grains have a mean diameter of at least 0.5 $\mu$m.

7. The color photographic silver halide material as claimed in claim 1, wherein the silver halide comprises at least 98.5% of AgCl.

8. The color photographic material as claimed in claim 4, wherein M is triethylammonium.

9. The color photographic material according to claim 4, wherein $R_{22}$ is chlorine or fluorine and $R_{25}$ is chlorine or fluorine.

10. The color photographic material according to claim 5, wherein $R_{31}$, $R_{32}$, and $R_{33}$ are identical or different and are hydrogen and an alkyl group containing 1 to 4 carbon atoms and $R_{37}$ is ballast group.

11. The color photographic material according to claim 10, wherein $R_{31}$, $R_{32}$, and $R_{33}$ are hydrogen or methyl.

12. The color photographic material according to claim 4, wherein 1 and m are 3 and M is triethylammonium.

13. The color photographic material according to claim 12, wherein $X_3$ is S, $R_{24}$ is hydrogen and $R_{25}$ is Cl.

14. The color photographic material according to claim 12, wherein $X_3$ is O.

15. The color photographic material to claim 1, wherein the silver halide emulsion contains $10^{-7}$ to $10^{-3}$ mol of at least one metal salt of Pr.

* * * * *

UNITED STATES PATENT AND TRADEMARK OFFICE

CERTIFICATE OF CORRECTION

PATENT NO. : 6,451,521 B1
DATED : September 17, 2002
INVENTOR(S) : Berthaller et al.

It is certified that error appears in the above-identified patent and that said Letters Patent is hereby corrected as shown below:

Column 15,
Line 36, delete "AgCI" and insert -- AgCl --.

Signed and Sealed this

Eighth Day of April, 2003

JAMES E. ROGAN
*Director of the United States Patent and Trademark Office*